US005715868A

United States Patent [19]

Ching et al.

[11] Patent Number: 5,715,868

[45] Date of Patent: Feb. 10, 1998

[54] SPOUT WITH HUB

[75] Inventors: Fred Y. F. Ching, Canyon Country; Matthew J. Evans, Pasadena; Christopher G. Gurr, Marina del Rey, all of Calif.

[73] Assignee: Emhart Inc., Newark, Del.

[21] Appl. No.: 807,849

[22] Filed: Feb. 26, 1997

Related U.S. Application Data

[63] Continuation of Ser. No. 535,689, Sep. 28, 1995, abandoned.

[51] Int. Cl.[6] ..... E03C 1/02

[52] U.S. Cl. ..... 137/801; 4/678; 137/615

[58] Field of Search ..... 4/678; 137/615, 137/801; 285/354

[56] References Cited

U.S. PATENT DOCUMENTS

| | | | |
|---|---|---|---|
| D. 339,853 | 9/1993 | Higgins . | |
| 753,749 | 3/1904 | Stapley . | |
| 2,685,461 | 8/1954 | Mueller | 285/354 X |
| 3,393,930 | 7/1968 | Ziherl et al. | 285/354 X |
| 4,037,624 | 7/1977 | Turner . | |
| 4,456,287 | 6/1984 | Bisonaya | 137/615 X |
| 4,976,287 | 12/1990 | Sheen | 137/615 X |
| 4,997,008 | 3/1991 | Zbin | 137/615 X |
| 5,165,168 | 11/1992 | Higgins . | |
| 5,397,102 | 3/1995 | Kingman | 137/615 X |

FOREIGN PATENT DOCUMENTS

| | | | |
|---|---|---|---|
| 0117504 | 9/1984 | European Pat. Off. | 4/678 |
| 2908082 | 3/1980 | Germany . | |
| 3324603 | 10/1984 | Germany . | |
| 308086 | 1/1969 | Sweden | 285/354 |
| 72397 | 11/1985 | Taiwan . | |
| 147699 | 12/1990 | Taiwan . | |
| 72396 | 11/1995 | Taiwan . | |
| 1367721 | 9/1974 | United Kingdom . | |

*Primary Examiner*—Gerald A. Michalsky
*Attorney, Agent, or Firm*—J. Bruce Hoofnagle

[57] ABSTRACT

A single-piece tube 20 is formed to include a hub 30 at first end 26 of the tube with a spout 44 extending from the hub to a second 28 of the tube. A tapered transition surface 38 extends between the hub 30 and the spout 44. A bevel 34 is formed at the base of the hub 30 on an outer surface 22 thereof adjacent the end 26 of the tube 20. An annular bead 36 is formed on the outer surface 22 of the hub 30 at a location spaced from the bevel 34 to define a space 46 between the bevel and the bead. A pair of bends 40 and 42 are formed in spaced portions of the spout 44. In another embodiment, an annular groove 50 is formed in the outer surface 22 of the hub 30 instead of the bevel 34 and the bead 36. An O-ring 48 can be located in the space 46 or the groove 50. The single-piece tube 20 formed with the hub 30 and the spout 44 can be assembled with a water mixing facility 56.

5 Claims, 3 Drawing Sheets

SPOUT WITH HUB

This is a Continuation of application Ser. No. 08/535,689 filed Sep. 28, 1995, now abandoned.

BACKGROUND OF THE INVENTION

This invention relates to a spout with a hub and particularly relates to a spout with a hub which is formed from a single tube.

In many instances, spouts which form an element of a kitchen faucet include a metallic hub and a metallic spout tube which are joined together by a metal-to-metal bonding such as brazing. The hub and the spout tube are formed with fluid passages which are in communication to facilitate the flow of water therethrough.

When manufacturing the hub, various forming and machining operations are required. Also, the spout tube requires several steps in the manufacture of the spout for assembly with the hub. The hub and the spout must then be processed through a bonding procedure. The processes practiced in making such a hub and spout, and then assembling the hub and spout, are time consuming and costly.

Thus, there is a need for a simplified and less costly manner of making a spout and hub assembly for forming a portion of a faucet.

SUMMARY OF THE INVENTION

It is, therefore, an object of this invention to provide a inexpensive spout with hub which is relatively simple to manufacture.

Another object of this invention is to provide a spout with hub which is easily assembled with other elements to form a faucet.

With these and other objects in mind, this invention contemplates a spout with hub having a first tubular portion of a first diameter joined integrally with a second tubular of a second diameter larger than the first diameter.

This invention further contemplates a spout with hub in which the spout is formed in a section of a tube and the hub is formed in an adjoining section of the tube.

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
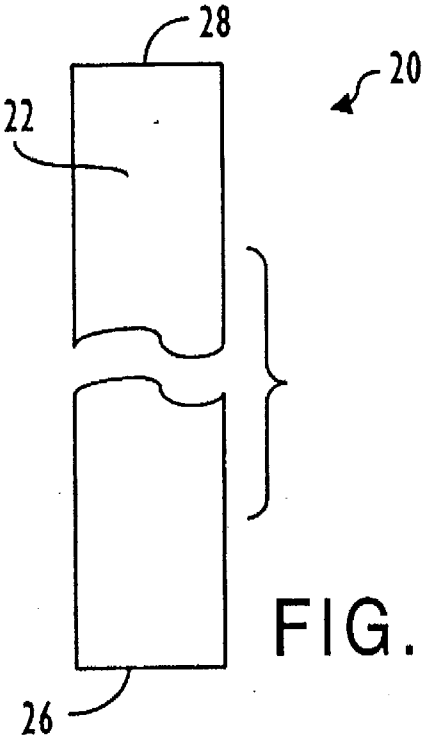
FIG. 1 is a side view of a cylindrical tube.
Figure 2:
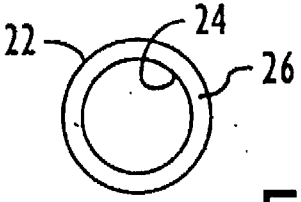
FIG. 2 is an end view of the cylindrical tube of FIG. 1.

As shown in FIGS. 1 and 2, a tube 20 is formed in a cylindrical shape with a prescribed diameter. The tube 20 has an outer surface 22, an internal surface 24 (FIG. 2), a first end 26 and a second end 28. The tube 20 is composed of a metal such as, for example, a copper alloy which is the material used in the preferred embodiment. Also, in the preferred embodiment, the tube 20 is about eleven inches in axial length, about three-fourths inch in diameter and has an approximate wall thickness of 0.032 inch. Tubes formed from other materials and having different dimensional parameters than those of the preferred embodiment could be used without departing from the spirit and scope of the invention.

Figure 3:
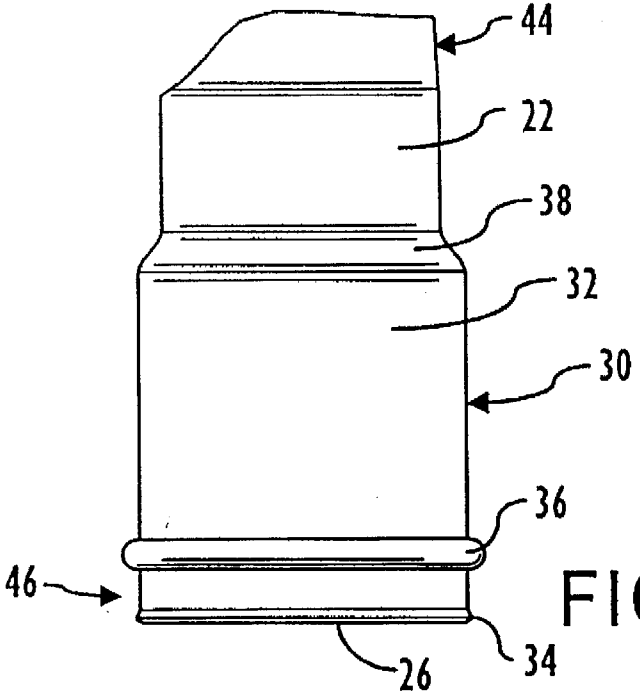
FIG. 3 is a side view of a portion of the tube of FIG. 1 formed in the configuration of a spout with a hub in accordance with certain principles of the invention.

Referring to FIG. 3, the tube 20 of FIG. 1 has been processed through a reshaping procedure to enlarge a section of the tube adjacent the end 26 thereof to form a cylindrical hub 30 with a diameter which is larger than the prescribed diameter of the tube. In particular, hub 30 has been enlarged to form a cylindrical portion 32. A flared lip or bevel 34 is formed at the end 26 of the tube 20. A rounded rib or bead 36 is formed around a lower area of the cylindrical portion 32. A transition surface 38 is formed between the cylindrical portion 32 and the outer surface 22 of the portion of the tube 20 immediately adjacent and inboard of the hub 30.

Figure 4:
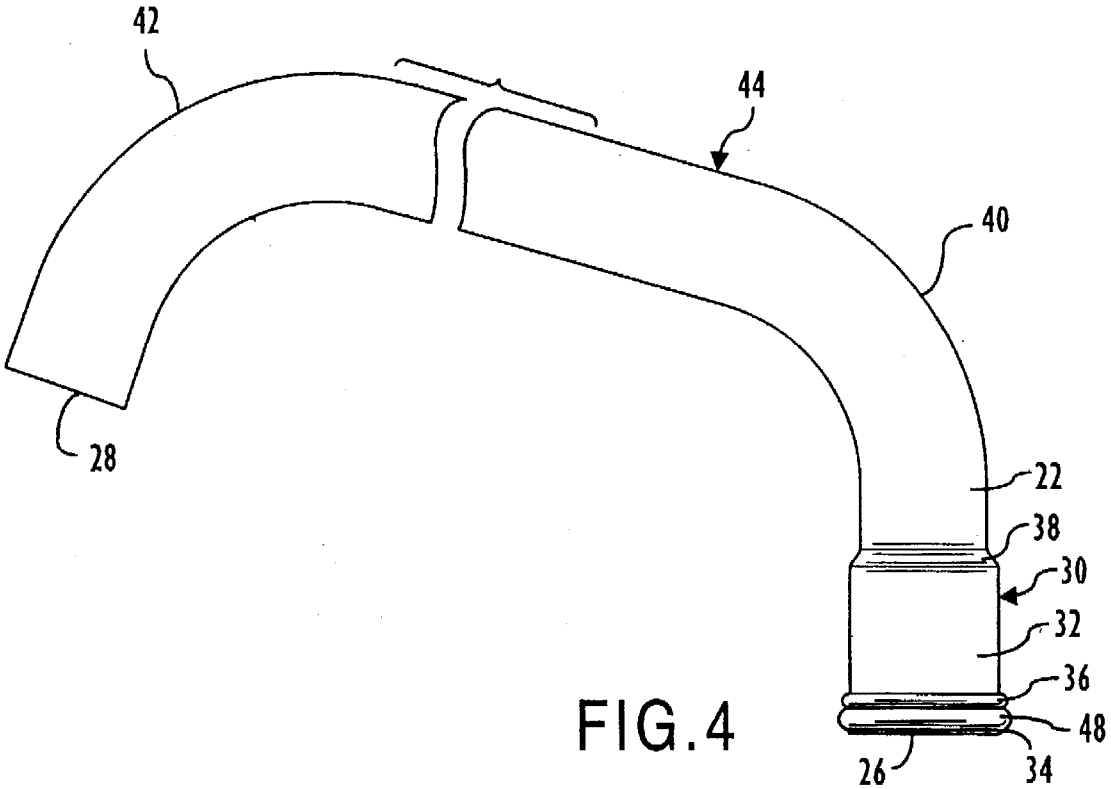
FIG. 4 is a side view of the formed spout and hub of FIG. 3 with a straight section removed for illustration purposes.

As shown in FIG. 4, the remainder of the tube 20 of FIG. 1 is not enlarged but is formed with a pair of spaced bends 40 and 42 to complete the formation of a spout 44. Thus, the spout 44 and the hub 30 are formed from the single tube 20 and remain as a single piece after the formation of the spout and the hub. A space 46 (FIG. 3) is defined between the bevel 34 and the bead 36 for receipt of an O-ring 48 as shown in FIG. 4.

The embodiment illustrated in FIG. 3 represents the preferred embodiment of the invention.

Figure 5:
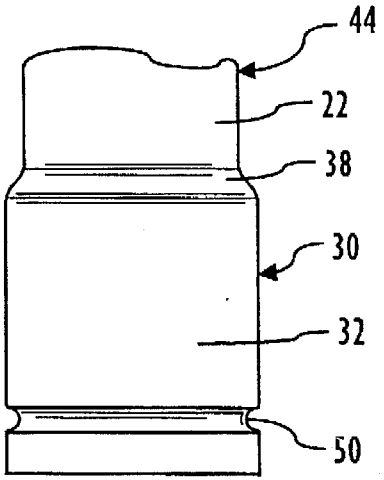
FIG. 5 is a side view of a portion of the tube of FIG. 1 formed in the configuration of another embodiment of a spout with a hub in accordance with certain principles of the invention.

Another embodiment of the invention is shown in FIG. 5 where instead of forming the bevel 34 and the bead 36 to define the space 46, an annular groove 50 is formed in the cylindrical portion 32 of the hub 30 for receipt of the O-ring 48 (FIG. 4). In this embodiment, the hub 30 and the spout 44 are also formed from the single piece of tube 20.

Figure 6:
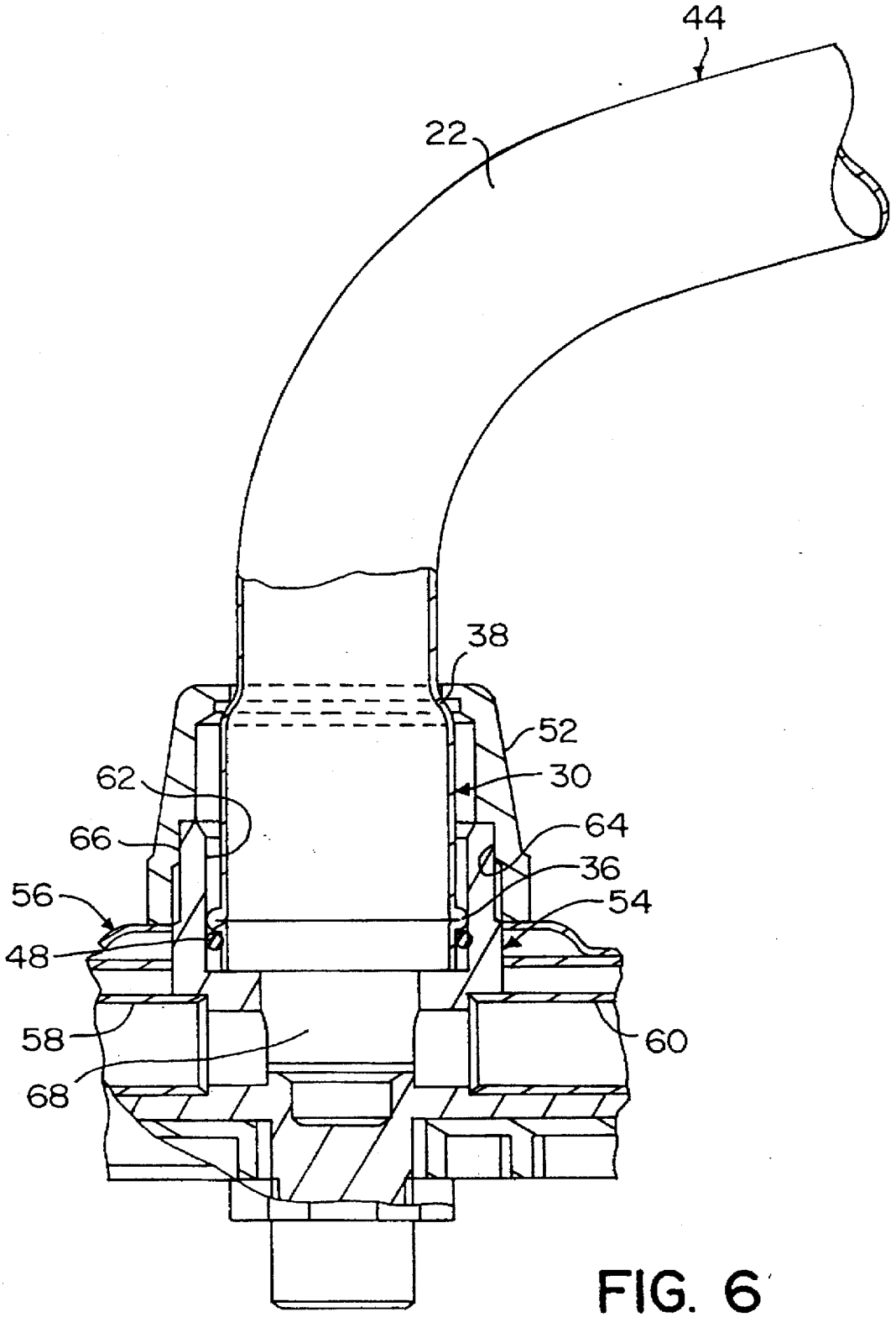
FIG. 6 is a sectional view showing the spout with hub of FIG. 3 in assembly with a water mixing facility.

Referring to FIG. 6, a trim nut 52 is positioned over the end 28 (FIG. 4) of the spout 44 and moved to the position illustrated in FIG. 6. The hub 30 is positioned adjacent a center body 54 of a water mixing facility 56. The center body 54 is connected to a pair of conduits 58 and 60 which are connected to end bodies (not shown) for supplying hot and cold water, respectively, to the center body. The center body 54 is also formed with a cylindrical shell 62 at the top thereof for receipt of the lower end of the hub 30. After the hub 30 has been located in the shell 62 of the center body 54, the trim nut 52 is manipulated so that threads 64 thereof are moved into engagement with threads 66 of the center body to secure the hub with the center body. Water can then flow from the conduits 58 and 60 to a chamber 68 of the center body 54 and then through the hub 30 and the spout 44 exiting at the end 28 (FIG. 4).

In general, the above-identified embodiments are not to be construed as limiting the breadth of the present invention. Modifications, and other alternative constructions, will be apparent which are within the spirit and scope of the invention as defined in the appended claims.

What is claimed:

1. A spout with hub, which comprises:

a tube formed from a single piece of material;

the tube formed with a first section having a first diameter defining a spout;

the tube formed with a second section having a second diameter larger than the first diameter defining a hub;

the hub of the tube being formed in a cylindrical shape and extending axially inward from a first end of the tube for a prescribed axial distance;

the spout of the tube extending from the hub to a second end of the tube;

a defined annular space formed entirely on an outer surface of the hub and including a pair of edges, which are spaced axially by a distance less than the prescribed axial distance, and a base located on the outer surface of the hub between and recessed radially inward from the spaced edges for ultimate receipt of a compliant element; and a first of the pair of edges of the defined space is formed by a bead formed radially outward from and around the outer surface of the hub at an axial location spaced from the first end of the tube.

2. The spout with hub as set forth in claim 1, wherein a second of the pair of edges of the defined space is formed by a bevel formed radially outward in the outer surface of the hub.

3. The spout with hub as set forth in claim 2, wherein the bevel is located at the first end of the tube.

4. The spout with hub as set forth in claim 1, wherein a first of the pair of edges of the defined space is formed by a bead formed radially outward at a first location around the outer surface of the hub and spaced from the first end of the tube and a second of the pair of edges of the defined space is formed by a bevel formed radially outward at a second location on the hub spaced axially from the first location and closer to the first end of the tube.

5. The spout with hub as set forth in claim 1, wherein the bead is a crimped portion of the tube at a location spaced from the first end of the tub.

* * * * *